US010234795B2

(12) United States Patent
Yagi

(10) Patent No.: US 10,234,795 B2
(45) Date of Patent: Mar. 19, 2019

(54) IMAGE FORMING APPARATUS HAVING PHOTOSENSITIVE MEMBER AND INTERMEDIATE TRANSFER MEMBER WITH SURFACE LAYERS CONTAINING ACRYLIC RESIN

(71) Applicant: CANON KABUSHIKI KAISHA, Tokyo (JP)

(72) Inventor: Yasutaka Yagi, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/873,947

(22) Filed: Jan. 18, 2018

(65) Prior Publication Data

US 2018/0210374 A1 Jul. 26, 2018

(30) Foreign Application Priority Data

Jan. 26, 2017 (JP) ..... 2017-012547

(51) Int. Cl.

| | |
|---|---|
| ***G03G 15/16*** | (2006.01) |
| ***G03G 5/02*** | (2006.01) |
| ***G03G 5/14*** | (2006.01) |
| ***G03G 5/147*** | (2006.01) |
| ***G03G 5/07*** | (2006.01) |

(52) U.S. Cl.

CPC ..... *G03G 15/162* (2013.01); *G03G 5/0208* (2013.01); *G03G 5/075* (2013.01); *G03G 5/142* (2013.01); *G03G 5/14734* (2013.01); *G03G 5/14795* (2013.01)

(58) Field of Classification Search

CPC .. G03G 15/162; G03G 5/14795; G03G 5/142; G03G 5/075; G03G 5/14734; G03G 5/0208

See application file for complete search history.

(56) References Cited

U.S. PATENT DOCUMENTS

| | | | | |
|---|---|---|---|---|
| 2006/0029439 | A1* | 2/2006 | Kitani | G03G 9/0821 399/302 |
| 2007/0206979 | A1* | 9/2007 | Ohta | G03G 15/1685 399/302 |
| 2007/0217820 | A1* | 9/2007 | Shigemori | G03G 5/0666 399/134 |
| 2010/0119260 | A1* | 5/2010 | Egawa | G03G 5/075 399/159 |

(Continued)

FOREIGN PATENT DOCUMENTS

| | | | |
|---|---|---|---|
| JP | H10-26891 | A | 1/1998 |
| JP | 2003-066737 | A | 3/2003 |

(Continued)

*Primary Examiner* — Francis C Gray

(74) *Attorney, Agent, or Firm* — Venable LLP

(57) ABSTRACT

The image forming apparatus includes a photosensitive member configured to bear a toner image, the photosensitive member having a surface layer containing acrylic resin, and an intermediate transfer member configured to secondarily transfer the toner image having been primarily transferred from the photosensitive member onto a transfer material, the intermediate transfer member having a surface layer containing acrylic resin and having a ten-point average roughness Rz set within a range of 0.35 μm≤Rz≤1.5 μm.

8 Claims, 3 Drawing Sheets

(56) References Cited

U.S. PATENT DOCUMENTS

| | | | | |
|---|---|---|---|---|
| 2012/0008984 | A1* | 1/2012 | Kami | G03G 5/0525 399/159 |
| 2013/0244148 | A1* | 9/2013 | Yamano | G03G 5/0514 430/32 |
| 2014/0113225 | A1 | 4/2014 | Yoshimura et al. | |
| 2014/0377695 | A1 | 12/2014 | Kameyama et al. | |
| 2017/0102627 | A1* | 4/2017 | Okuda | G03G 5/04 |
| 2017/0277080 | A1* | 9/2017 | Daishi | G03G 15/162 |

FOREIGN PATENT DOCUMENTS

| | | | |
|---|---|---|---|
| JP | 2004-109754 | A | 4/2004 |
| JP | 2013-029812 | A | 2/2013 |
| JP | 2015-028613 | A | 2/2015 |

* cited by examiner

IMAGE FORMING APPARATUS HAVING PHOTOSENSITIVE MEMBER AND INTERMEDIATE TRANSFER MEMBER WITH SURFACE LAYERS CONTAINING ACRYLIC RESIN

BACKGROUND OF THE INVENTION

Field of the Invention

The present invention relates to an image forming apparatus, for example, a copying machine, a printer, or a facsimile machine, which uses an electrophotographic system or an electrostatic recording system.

Description of the Related Art

Conventionally, for example, as an image forming apparatus using an electrophotographic system, there has been known an image forming apparatus using an intermediate transfer system. In the intermediate transfer system, toner images formed on photosensitive members are primarily transferred onto an intermediate transfer member and thereafter secondarily transferred onto a transfer material such as a recording sheet.

In Japanese Patent Application Laid-Open No. 2013-29812, an image forming apparatus using acrylic resin for a surface layer of a photosensitive member is disclosed.

SUMMARY OF THE INVENTION

According to one embodiment of the present invention, there is provided an image forming apparatus, including: a photosensitive member, which is configured to bear a toner image, and has a surface layer containing acrylic resin; and an intermediate transfer member, which is configured to secondarily transfer the toner image having been primarily transferred from the photosensitive member onto a transfer material, and has a surface layer containing acrylic resin and having a ten-point average roughness Rz set within a range of 0.35 μm≤Rz≤1.5 μm.

Further features of the present invention will become apparent from the following description of exemplary embodiments with reference to the attached drawings.

DESCRIPTION OF THE EMBODIMENTS

Now, an image forming apparatus according to the present invention is described in detail with reference to the drawings.

Embodiment

1. Overall Configuration and Operation of Image Forming Apparatus

Figure 1:
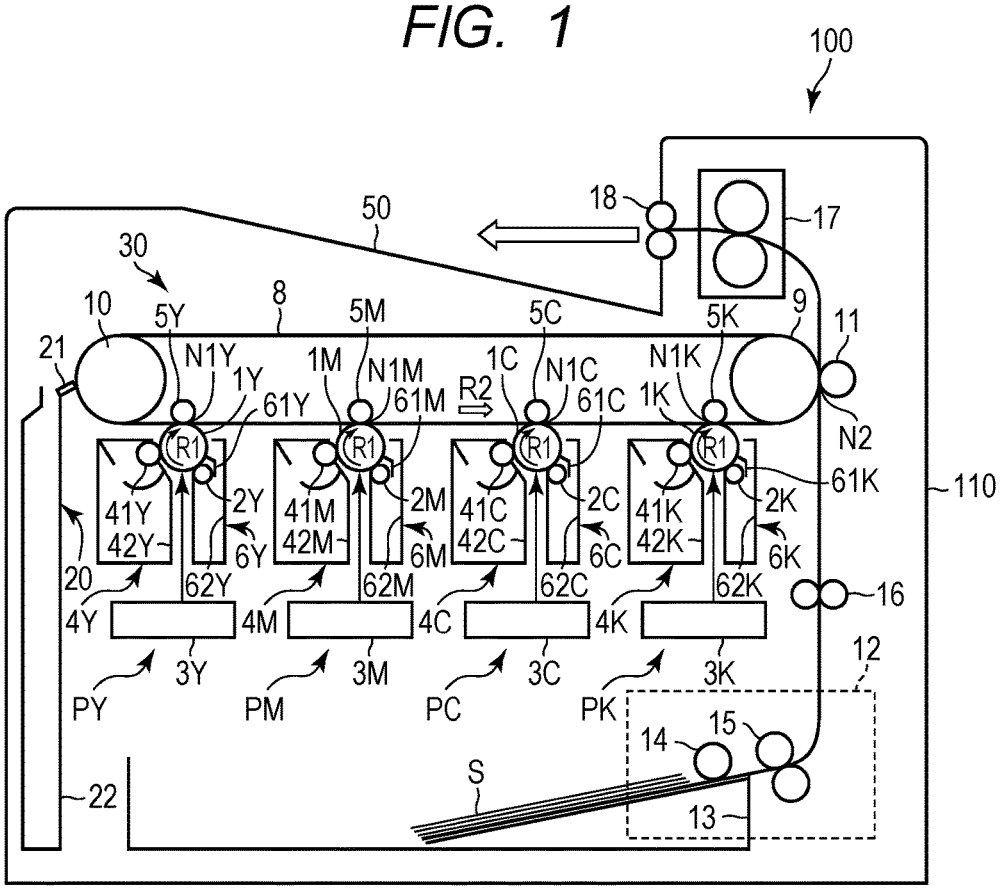
FIG. 1 is a schematic sectional view of an image forming apparatus.

FIG. 1 is a schematic sectional view of an image forming apparatus 100 according to an embodiment of the present invention. The image forming apparatus 100 according to this embodiment is a tandem type (in-line system) laser beam printer employing an intermediate transfer system, which is capable of forming a full-color image using an electrophotographic system. The image forming apparatus 100 includes, as a plurality of image forming portions (stations), a first image forming portion PY configured to form a yellow (Y) toner image, a second image forming portion PM configured to form a magenta (M) toner image, a third image forming portion PC configured to form a cyan (C) toner image, and a fourth image forming portion PK configured to form a black (K) toner image. In this embodiment, configurations and operations of the image forming portions PY, PM, PC, and PK are substantially the same except for that colors of toner to be used in a developing step described later are different. Thus, unless distinction is otherwise required, the components are collectively described without the suffixes Y, M, C, and K of the reference symbols, which respectively denote colors for which the components are provided. In this embodiment, the image forming portion P includes a photosensitive drum 1, a charge roller 2, an exposure device 3, a developing device 4, a primary transfer roller 5, and a drum cleaning device 6, which are described later.

The photosensitive drum 1, which is an electrophotographic photosensitive member (photosensitive member) having a drum shape (cylinder shape) and serves as an image bearing member configured to bear a toner image, is driven to rotate at a predetermined peripheral speed in a direction indicated by the arrow R1 in FIG. 1 (clockwise direction. A surface of the photosensitive drum 1 being rotated is charged by the charge roller 2, which is a charge device having a roller shape and serves as a charging unit, to a predetermined potential with a predetermined polarity (negative polarity in this embodiment). At the time of charging, a predetermined charging voltage (charging bias) is applied to the charge roller 2. The surface of the photosensitive drum 1 having been charged is scanned and exposed to light in accordance with an image signal by the exposure device (laser scanner unit) 3 serving as an exposure unit. As a result, an electrostatic latent image (electrostatic image) is formed on the photosensitive drum 1. The electrostatic latent image formed on the photosensitive drum 1 is developed (visualized) by the developing device 4 serving as a developing unit using toner serving as developer, thereby forming a toner image on the photosensitive drum 1. The developing device 4 includes a developing roller 41 and a toner container 42. The developing roller 41 serves as a developer carrying member. The toner container 42 is configured to store toner. At the time of developing, a predetermined developing voltage (developing bias) is applied to the developing roller 41. In this embodiment, toner having been charged to the same polarity (in this embodiment, negative polarity) as the charging polarity of the photosensitive drum 1 adheres to an exposed portion on the photosensitive drum 1 which is reduced in absolute value of the potential by being uniformly charged and thereafter exposed to light.

An intermediate transfer belt 8 which is formed of an endless belt is arranged so as to be opposed to the respective photosensitive drums 1 of the image forming portions P. The intermediate transfer belt 8 is an example of an intermediate transfer member which is configured to allow the toner image primarily transferred from the image bearing member to be conveyed so as to be secondarily transferred to the transfer material. The intermediate transfer belt 8 is stretched around a drive roller 9 and a driven roller 10 being a plurality of tensioning rollers (support members), and is tensioned with a predetermined tensile force. The drive roller 9 is driven to rotate so that the intermediate transfer belt 8 is caused to rotate (move around) in a direction indicated by the arrow R2 in FIG. 1 (counterclockwise direction) at a peripheral speed corresponding to the peripheral speed of the photosensitive drum 1. In this embodiment, the peripheral speed (process speed) of the intermediate transfer belt 8 is 210 mm/sec. On an inner peripheral surface side of the intermediate transfer belt 8, primary transfer rollers 5, which are primary transfer members each having a roller shape and each serving as a primary transfer unit, are arranged so as to correspond to the respective photosensitive drums 1. The primary transfer rollers 5 are pressed toward the photosensitive drums 1 through intermediation of the intermediate transfer belt 8, and form primary transfer portions (primary transfer nips) N1 at which the photosensitive drums 1 are held in contact with the intermediate transfer belt 8. The toner image formed on the photosensitive drum 1 as described above is primarily transferred at the primary transfer portion N1 onto the intermediate transfer belt 8 being rotated. At the time of primary transfer, a primary transfer voltage (primary transfer bias) which is a direct-current voltage having a polarity opposite to the charging polarity (regular charging polarity) of the toner given at the time of developing (in this embodiment, positive polarity) is applied to the primary transfer roller 5. For example, at the time of forming a full-color image, toner images of respective colors, that is, yellow, magenta, cyan, and black, which are formed on the respective photosensitive drums 1Y, 1M, 1C, and 1K, are primarily transferred in a sequential manner onto the intermediate transfer belt 8 in a superimposed state.

At a position opposed to the drive roller 9, which also serves as a secondary transfer opposed roller, on an outer peripheral surface side of the intermediate transfer belt 8, a secondary transfer roller 11 being a roller-type secondary transfer member serving as a secondary transfer unit is arranged. The secondary transfer roller 11 is pressed toward the drive roller 9 through intermediation of the intermediate transfer belt 8 to form a secondary transfer portion (secondary transfer nip) N2 at which the intermediate transfer belt 8 and the secondary transfer roller 11 come into contact with each other. The toner images formed on the intermediate transfer belt 8 as described above are secondarily transferred onto a transfer material S, for example, recording paper nipped between the intermediate transfer belt 8 and the secondary transfer roller 11 to be conveyed at the secondary transfer portion N2. During secondary transfer, a secondary transfer voltage (secondary transfer bias) being a direct-current voltage with the polarity opposite to the original charging polarity of the toner (positive polarity in this embodiment) is applied to the secondary transfer roller 11. The transfer material S is received in a transfer material cassette 13, is fed from the transfer material cassette 13 by a feed roller 14 of a feeding apparatus 12, and is conveyed by a conveyance roller pair 15 of the feeding apparatus 12 to a registration roller pair 16. Then, the transfer material S is fed by the registration roller pair 16 to the secondary transfer portion N2 in conformity with a timing of the toner images on the intermediate transfer belt 8.

The transfer material S having the toner images transferred thereon is heated and pressurized by a fixing device 17 serving as a fixing unit so that the toner images are fixed (melted and caused to firmly adhere) to a surface of the transfer material S. Thereafter, the transfer material S is delivered by a pair of delivery rollers 18 to a delivery tray 50 provided outside the apparatus main body 110 of the image forming apparatus 100.

Further, toner remaining on the photosensitive drum 1 after the primary transfer (primary transfer residual toner) is removed from the photosensitive drum 1 and collected by the drum cleaning device 6 serving as a photosensitive member cleaning unit. The drum cleaning device 6 includes a drum cleaning blade 61 serving as a cleaning member and a toner collection container 62. The drum cleaning device 6 scrapes off the primary transfer residual toner from the surface of the photosensitive drum 1 being rotated with use of the drum cleaning blade 61, and stores the primary transfer residual toner in the toner collection container 62. Further, toner remaining on the intermediate transfer belt 8 after the secondary transfer (secondary transfer residual toner) is removed from the intermediate transfer belt 8 and collected by a belt cleaner 20 serving as an intermediate transfer member cleaning unit. The belt cleaning device 20 includes a belt cleaning blade 21 serving as a cleaning member and a toner collection container 22. The belt cleaning device 20 scrapes off the secondary transfer residual toner from the surface of the intermediate transfer belt 8 being rotated with use of the belt cleaning blade 21, and stores the secondary transfer residual toner in the toner collection container 22.

In this embodiment, in each image forming portion P, the photosensitive drum 1 and process units, that is, the charge roller 2, the developing device 4, and the drum cleaning device 6 which act on the photosensitive drum 1 integrally construct a process cartridge 7 which is removably mounted to the apparatus main body 110. Further, in this embodiment, the intermediate transfer belt 8, the drive roller 9, the driven roller 10, and the primary transfer rollers 5Y, 5M, 5C, and 5K integrally construct an intermediate transfer unit 30 which is removably mounted to the apparatus main body 110.

The toner used in this embodiment is substantially spherical toner having an average particle diameter of from 5 μm to 8 μm (one-component nonmagnetic developer). In this embodiment, two transfers in total including the primary transfer and the secondary transfer are performed, and hence spherical toner which is excellent in transfer performance is used as toner. The toner used in this embodiment is manufactured by a polymerization method. The toner is formed into a substantially spherical shape because of the manufacturing method. Further, in the toner used in this embodiment, wax is contained in a core. Styrene-butylacrylate is used for a binder resin layer on the core. Styrene-polyester is used for a resin layer being an outermost shell on the binder resin layer. Further, for the purpose of stabilizing the charging ability and providing lubricity, an external additive is added to the toner. As binder resin for toner, there may be used a vinyl-based copolymer made of styrene-based resin and acryl-based resin, or polyester resin.

2. Photosensitive Drum

Figure 2:
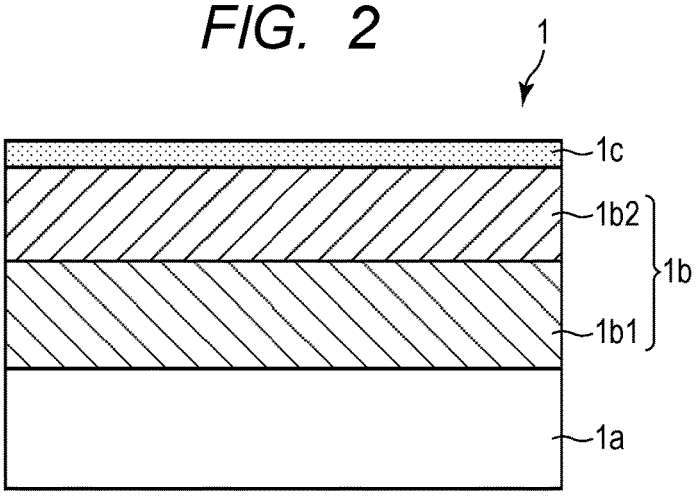
FIG. 2 is a sectional view for schematically illustrating a layer configuration of a photosensitive drum.

Next, the photosensitive drum 1 is further described. FIG. 2 is a sectional view for schematically illustrating a layer configuration of the photosensitive drum 1.

In general, the photosensitive drum 1 includes a conductive support member 1*a* and a photosensitive layer 1*b* formed on the support member 1*a*. The photosensitive layer 1*b* may be a photosensitive layer of a single-layer type which contains a charge transporting substance and a charge producing substance in the same layer, or may be a photosensitive layer of a multi-layer type which is formed by laminating a charge producing layer 1*b*1 containing the charge producing substance and a charge transporting layer 1*b*2 containing the charge transporting substance. FIG. 2 is an illustration of a layer configuration of a photosensitive drum 1 of the multi-layer type. In this embodiment, the photosensitive drum 1 of the multi-layer type is used. Further, a protective layer 1*c* may be provided on the photosensitive layer 1*b*. In this embodiment, the protective layer 1*c* is provided to the photosensitive drum 1. A surface layer of the photosensitive drum 1 is a layer which is provided on the outermost side of the photosensitive drum 1. That is, the surface layer of the photosensitive drum 1 is a layer which is most apart from the support member 1*a* and has a surface for carrying toner. Thus, in this embodiment, the surface layer of the photosensitive drum 1 corresponds to the protective layer 1*c*.

The surface layer of the photosensitive drum 1 in the present invention (protective layer 1*c* in this embodiment) contains acrylic resin (polymer of acrylic ester or methacrylic ester). More specifically, the surface layer of the photosensitive drum 1 (protective layer 1*c* in this embodiment) contains the acrylic resin as a main component. In this embodiment, as the resin (binding resin) forming the protective layer 1*c*, there is used resin which is obtained by crosslinking an acrylic compound (monomer of acrylic resin) or a methacrylic compound (monomer of methacrylic resin) having an unsaturated bond through use of radiation such as an ultraviolet ray or an electron beam. Additives such as antioxidant, ultraviolet absorber, plasticizer, fluorine atom-containing resin particles, and a silicone compound may be added to the protective layer 1.

The above-mentioned layers can be formed by applying application liquid to a layer below each layer. When the application liquid is to be applied, there can be used an application method such as a dip application method (dip coating method), a spray coating method, a spinner coating method, a roller coating method, a Meyer bar coating method, or a blade coating method.

It is preferred that a surface roughness of the surface layer of the photosensitive drum 1 (protective layer 1*c* in this embodiment) in ten-point average roughness Rz (JIS-B0601:1994) be within the range of 0.03 μm≤Rz≤1.0 μm. The ten-point average roughness Rz smaller than 0.03 μm is not preferred because a friction force with respect to the drum cleaning blade 61 increases so that blade noise or blade turn-up may be caused. The blade noise is a phenomenon in which noise occurs due to friction contact between the drum cleaning blade 61 and the photosensitive drum 1. The blade turn-up is a phenomenon in which a free end portion of the drum cleaning blade 61, which is held in abutment against the photosensitive drum 1 so as to be oriented toward an upstream side in a moving direction of the surface of the photosensitive drum 1 in a normal state, is warped in the moving direction of the surface of the photosensitive drum 1. The ten-point average roughness Rz larger than 1.0 μm is not preferred because the light sensitivity characteristic of the photosensitive drum 1 is degraded.

For measurement of the ten-point average roughness Rz of the surface layer of the photosensitive drum 1, a contact type surface roughness measurement instrument "Surfcom 1500SD (manufactured by Tokyo Seimitsu Co., Ltd.)" was used. The measurement conditions were set with a measurement length of 4 mm, a reference length of 0.8 mm, a measurement speed of 0.1 mm/sec, and a cutoff value of 0.8 mm.

Further, in this embodiment, a surface roughness of the surface layer of the photosensitive drum 1 was adjusted by grinding (roughening) the surface layer of the photosensitive drum 1 with a wrapping film. However, the method of adjusting the surface roughness of the surface layer of the photosensitive drum 1 is not limited thereto, and any other method may be employed as long as the surface roughness can be adjusted to the above-mentioned range of the ten-point average roughness Rz. For example, there can be employed a method of bringing a mold having a predetermined shape into press-contact with the surface of the photosensitive drum 1 to perform shape transfer.

3. Intermediate Transfer Belt

Figure 3:
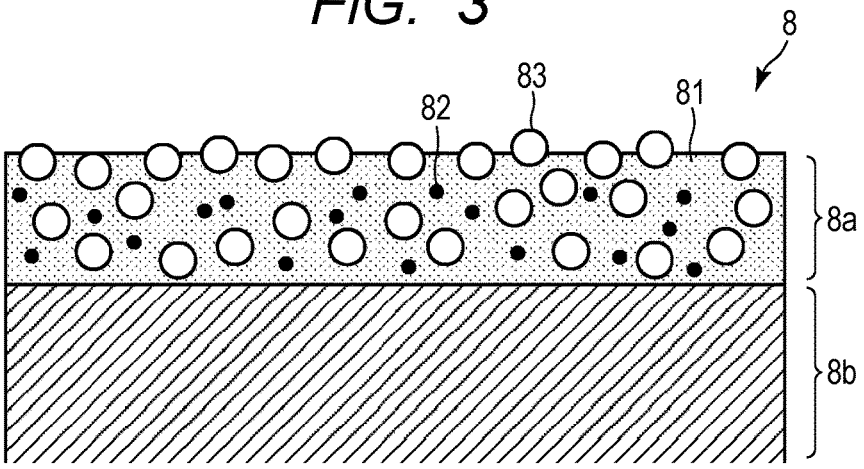
FIG. 3 is a sectional view for schematically illustrating a layer configuration of an intermediate transfer belt.

Next, further description is made of the intermediate transfer belt 8. FIG. 3 is a sectional view for schematically illustrating a layer configuration of the intermediate transfer belt 8.

In this embodiment, the intermediate transfer belt 8 includes a base layer 8*b* and a surface layer 8*a*. In this embodiment, the intermediate transfer belt 8 is constructed of two layers being the base layer 8*b*, and the surface layer 8*a* that is formed on the base layer 8*b*. The surface layer 8*a* is a layer which is provided on an outer peripheral surface side of the intermediate transfer belt 8 with respect to the base layer 8*b*, and has a surface for carrying (holding) toner transferred from the photosensitive drum 1.

As a material for the base layer 8*b*, there are given, for example, thermoplastic resins such as polycarbonate, polyvinylidene fluoride (PVDF), polyethylene, polypropylene, polymethylpentene-1, polystyrene, polyamide, polysulfone, polyarylate, polyethylene terephthalate, polybutylene terephthalate, polyethylene naphthalate, polybutylene naphthalate, polyphenylene sulfide, polyether sulfone, polyether nitrile, thermoplastic polyimide, polyether ether ketone, a thermotropic liquid crystal polymer, and polyamic acid. Two or more kinds of those materials can be used as a mixture. The base layer 8*b* can be obtained by: melting and kneading a conductive material or the like into any such thermoplastic resin; and then molding the resultant by a molding method appropriately selected from, for example, inflation molding, cylindrical extrusion molding, and injection stretch blow molding.

Meanwhile, the surface layer 8*a* of the intermediate transfer belt 8 in the present invention contains acrylic resin 81. More specifically, the surface layer 8*a* of the intermediate transfer belt 8 is formed of acrylic resin as a main component. In this embodiment, as the resin which forms the surface layer 8*a*, it is preferred to use the acrylic resin, which is a curable material cured by heat or irradiation of energy rays such as light (for example, ultraviolet ray) or an electron beam and is obtained by curing an acrylic copolymer having an unsaturated double bond. As the unsaturated double bond-containing acrylic copolymer, for example, an acrylic UV-curable resin ("OPSTAR 27501" (trade name) manufactured by JSR Corporation) can be used. That is, the intermediate transfer belt 8 has the surface layer (cured film) 8*a* obtained by irradiating a liquid containing a UV-curable monomer and/or oligomer component with an energy ray so as to cure the liquid.

In this embodiment, for adjustment of an electric resistance, a conductive material (conductive filler or electric resistance adjuster) 82 is added to the surface layer 8*a*. As the conductive material 82, an electron conductive material or an ion conductive material can be used. Examples of the electron conductive material include a particulate, fibrous, or flaky carbon-based conductive filler such as carbon black, a PAN-based carbon fiber, or ground expanded graphite. Further, examples of the electron conductive material include a particulate, fibrous, or flaky metal-based conductive filler of silver, nickel, copper, zinc, aluminum, stainless steel, iron, or the like. Further, examples of the electron conductive material include a particulate metal oxide-based conductive filler of zinc antimonate, antimony-doped tin oxide, antimony-doped zinc oxide, tin-doped indium oxide, aluminum-doped zinc oxide, or the like. Examples of the ion conductive material include an ionic liquid, a conductive oligomer, and a quaternary ammonium salt. One or more kinds can be used through appropriate selection from those conductive materials. In addition, the electron conductive material and the ion conductive material may be used as a mixture. Of those, a particulate metal oxide-based conductive filler (particles having a submicron size or smaller, etc.) is preferred from the viewpoint that a small addition amount suffices.

Further, in this embodiment, for the purpose of improving transfer efficiency and reducing a friction force with the belt cleaning blade 21, surface layer particles 83 are added to the surface layer 8*a*. The surface layer particles 83 are preferably solid lubricant, and are generally insulating particles. Examples of the surface layer particles 83 include fluorine-containing particles, such as polytetrafluoroethylene (PTFE) resin powder, trifluorochloroethylene resin powder, tetrafluoroethylene-hexafluoropropylene resin powder, vinyl fluoride resin powder, vinylidene fluoride resin powder, difluorodichloroethylene resin powder, and graphite fluoride, and copolymers thereof. One or more kinds can be used through appropriate selection from those particles. Further, the surface layer particles 83 may be solid lubricants, such as silicone resin particles, silica particles, and molybdenum disulfide powder. Of those, polytetrafluoroethylene (PTFE) resin particles (e.g., emulsion polymerization type PTFE resin particles) are preferred because the surface of each of the particles has a low friction coefficient, and the abrasion of another member that is brought into abutment with the surface of the intermediate transfer belt 8, such as the belt cleaning blade 21, can be reduced.

An example of a method of producing the surface layer 8*a* is schematically described as follows. Zinc antimonate particles serving as a conductive material and PTFE particles serving as a solid lubricant are mixed in an unsaturated double bond-containing acrylic copolymer, and the particles are dispersed and mixed by a high-pressure emulsification dispersing machine to produce a coating liquid for forming a surface layer. As a method of forming the surface layer 8*a* on the base layer 8*b* with use of the coating liquid for forming a surface layer, there may be given, for example, general coating methods such as dip coating, spray coating, roll coating, and spin coating. Appropriate selection of those methods can result in the formation of the surface layer 8*a* having a desired thickness.

It is preferred that a surface roughness of the surface layer 8*a* of the intermediate transfer belt 8 in ten-point average roughness Rz (JIS-B0601:1994) be within the range of 0.35 μm≤Rz≤1.5 μm. That is, as can be seen in evaluation results described later, when the photosensitive drum 1 and the intermediate transfer belt 8 each having a surface layer containing acrylic resin are used, a triboelectric charge (electric charge per unit mass of toner) imparting effect with respect to toner at the primary transfer portion N1 is improved. Further, it is found that such improvement in triboelectric charge imparting effect improves the primary transfer performance. However, the ten-point average roughness Rz smaller than 0.35 μm is not preferred because the triboelectric charge imparting effect with respect to toner at the primary transfer portion N1 is small, and the primary transfer performance is degraded. Further, the ten-point average roughness Rz larger than 1.5 is not preferred because an adhesion force between toner and the surface layer 8*a* of the intermediate transfer belt 8 is increased, and the secondary transfer performance is degraded.

According to the studies conducted by the inventors of the present invention, it has been found that the triboelectric charge imparting effect at the primary transfer portion N1 is effectively improved when the ten-point average roughness Rz of the surface layer of the intermediate transfer belt 8 on a side of receiving an image to be transferred at the time of primary transfer is larger than the ten-point average roughness Rz of the surface layer of the photosensitive drum 1. This is because, when the ten-point average roughness Rz of the surface layer of the intermediate transfer belt 8 is larger, a scraping force which is given when toner is transferred from the photosensitive drum 1 to the intermediate transfer belt 8 at the primary transfer portion N1 increases. Further, this is because, when the ten-point average roughness Rz of the surface layer of the photosensitive drum 1 is smaller, the separation performance which is given when toner separates from the photosensitive drum 1 at the primary transfer portion improves. As a result, toner is more likely to rotate at the primary transfer portion N1, and hence the triboelectric charge imparting effect can be improved.

Thus, when the relationship in which the ten-point average roughness Rz of the surface layer of the intermediate transfer belt 8 is larger than the ten-point average roughness Rz of the surface layer of the photosensitive drum 1 is given, the triboelectric charge imparting effect can be improved.

For measurement of the ten-point average roughness Rz of the surface layer of the intermediate transfer belt 8, the contact type surface roughness measurement instrument "Surfcom 1500SD (manufactured by Tokyo Seimitsu Co., Ltd.)" was used. The measurement conditions were set with a measurement length of 4 mm, a reference length of 0.8 mm, a measurement speed of 0.1 mm/sec, and a cutoff value of 0.8 mm.

Further, in this embodiment, a surface roughness of the surface layer of the intermediate transfer belt 8 was adjusted by grinding (roughening) the surface layer of the intermediate transfer belt 8 with a wrapping film. However, the method of adjusting the surface roughness of the surface layer of the intermediate transfer belt 8 is not limited thereto, and any other method may be employed as long as the surface roughness can be adjusted to the above-mentioned range of the ten-point average roughness Rz. For example, there can be employed a method of forming the intermediate transfer belt 8 with a mold having a predetermined shape.

Further, as can be seen in evaluation results described later, it has been found that the triboelectric charge imparting effect with respect to toner at the primary transfer portion N1 is further improved by giving a speed difference (peripheral speed difference) between a peripheral speed of the photosensitive drum 1 and a peripheral speed of the intermediate transfer belt 8. In this embodiment, the peripheral speed difference was given by setting the peripheral speed of the photosensitive drum 1 to be smaller than the peripheral speed of the intermediate transfer belt 8. However, according to the studies conducted by the inventors of the present invention, it has been found that the triboelectric charge imparting effect with respect to toner is not significantly changed even with an opposite relationship. For favorable primary transfer of a toner image, the peripheral speed difference ({(peripheral speed of intermediate transfer belt-peripheral speed of photosensitive drum)/peripheral speed of intermediate transfer belt}×100[%]) is set to 10% or less at most, preferably 5% or less, more preferably 3% or less.

Figure 4:
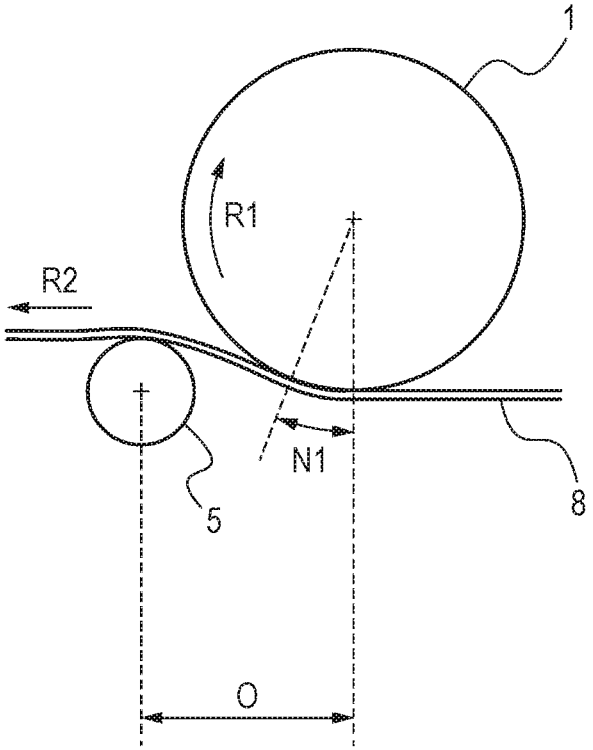
FIG. 4 is a sectional view at the nip portion between the photosensitive drum and the primary transfer roller 5.

In order to maximize the above-mentioned effect of the peripheral speed difference, details of the primary transfer portion in this embodiment are illustrated in FIG. 4. The triboelectric charge imparting effect achieved by giving the peripheral speed difference is further improved when a nip width N1 at the primary transfer portion is set to 0.5 mm or more. The nip width N1 herein is a width by which the photosensitive drum 1 and the intermediate transfer belt 8 are held in physical contact with each other as illustrated in FIG. 4. In order to set the nip width N1 to 0.5 mm or more, it is required that a length of an offset O, which is a distance between a center of the photosensitive drum 1 and a center of the primary transfer roller 5 as illustrated in FIG. 4, be 2 mm or more, and that a total pressure PT1 applied to the primary transfer roller 5 be 200 gf or more. In this embodiment, the length of the offset O is set to 5 mm, and the total pressure PT1 is set to 500 gf.

The intermediate transfer belt 8 preferably has a volume resistivity of from $10^9$ Ω·cm to $10^{12}$ Ω·cm from the viewpoint of satisfactory image formation. The volume resistivity is a value obtained through measurement with a general-purpose measuring device Hiresta UP MCP-HT450 (manufactured by Mitsubishi Chemical Corporation) under an environment of a temperature of 23.5° C. and a relative humidity of 60%.

4. Examples and Comparative Examples

The photosensitive drum 1 and the intermediate transfer belt 8 in examples and comparative examples described below were mounted to an evaluation device described below in this embodiment. Then, image formation was performed, and evaluation of an output image was performed.

As the evaluation device, a laser beam printer (product name: LaserJet Enterprise M553dn) manufactured by Hewlett-Packard Company was used. An evaluation image described below was formed in a normal mode (1/1 speed), and evaluation of the primary transfer performance was performed with a second image forming portion PM. The evaluation image was a solid image having a toner laid-on level on the photosensitive drum 1 set to 0.45 mg/cm$^2$. The evaluation was performed under the environment with a temperature of 23.5° C. and a relative humidity of 60%.

The evaluation method for the primary transfer performance was as follows. A power supply was turned OFF during the primary transfer operation to forcibly stop the operation of the image forming apparatus 100, and then primary transfer residual toner on the photosensitive drum 1 was collected with an adhesive tape. As evaluation standards, a level at which the primary transfer residual toner was able to be visually recognized was evaluated as "Fail", and a level at which the primary transfer residual toner was substantially not able to be visually recognized was evaluated as "good."

Measurement of the triboelectric charge of toner was performed in the following manner. Toner on the intermediate transfer belt 8 having been primarily transferred from the photosensitive drum 1 was sucked, and the weight and electric charge amount of sampled toner were measured with use of an electronic balance and a Faraday cage. Then, based on the measured values, a value of the triboelectric charge of toner defined by a unit of μC/g was calculated.

Among the examples, those evaluated as "good" in primary transfer performance were also additionally subjected to evaluation of secondary transfer performance. The evaluation device and the evaluation environment were the same as those in the case of evaluation of the primary transfer performance. The evaluation method for the secondary transfer performance was as follows. The same evaluation image as in the case of evaluation of the primary transfer performance was formed. Then, the power supply was turned OFF during the secondary transfer operation to forcibly stop the operation of the image forming apparatus 100, and then secondary transfer residual toner on the intermediate transfer belt 8 was collected with an adhesive tape. A level at which the secondary transfer residual toner was able to be visually recognized was evaluated as being poor, and a level at which the secondary transfer residual toner was substantially not able to be visually recognized was evaluated as being good.

For the purpose of providing the same conditions for each example and each comparative example, except for the configurations described below in particular (material and surface roughness), kinds and addition amounts of the conductive material 82 contained in the surface layer 8*a* of the intermediate transfer belt 8 and the surface layer particles 83 were set substantially the same. Further, for a similar purpose, in each example and each comparative example, an additive which significantly changes the primary transfer performance was not added to the surface layer (protective layer or charge transporting layer) of the photosensitive drum 1.

Evaluation results are shown in Table 1.

Example 1

The acrylic resin was used as the resin forming the protective layer 1*c* of the photosensitive drum 1. The thickness of the protective layer 1*c* was set to 3 μm, and the ten-point average roughness Rz of the protective layer 1*c* was set to 0.04 μm. Polyarylate resin was used as resin forming the charge transporting layer 1*b*2 of the photosensitive layer 1*b* of the photosensitive drum 1. The thickness of the charge transporting layer 1*b*2 was set to 20 μm.

Acrylic resin was used as resin forming the surface layer 8*a* of the intermediate transfer belt 8. The thickness of the surface layer 8*a* was set to 2 μm, and the ten-point average roughness Rz of the surface layer 8*a* was set to 0.35 μm. Polyethylenenaphthalate (PEN) resin was used as resin forming the base layer 8*b* of the intermediate transfer belt 8. The thickness of the base layer 8*b* was set to 65 μm. The volume resistivity of the intermediate transfer belt 8 was $10^{10}$ Ω·cm.

The peripheral speed difference between the photosensitive drum 1 and the intermediate transfer belt 8 was set to 0%.

Example 2

Conditions of Example 2 were the same as those of Example 1 except that the ten-point average roughness Rz of the protective layer 1*c* of the photosensitive drum 1 was set to 0.2 μm.

Example 3

Conditions of Example 3 were the same as those of Example 1 except that the ten-point average roughness Rz of the protective layer 1*c* of the photosensitive drum 1 was set to 0.6 μm, and that the ten-point average roughness Rz of the surface layer 8*a* of the intermediate transfer belt 8 was set to 0.7 μm.

Example 4

Conditions of Example 4 were the same as those of Example 1 except that the ten-point average roughness Rz of the surface layer 8*a* of the intermediate transfer belt 8 was set to 0.6 μm.

Example 5

Conditions of Example 5 were the same as those of Example 1 except that the ten-point average roughness Rz of the protective layer 1*c* of the photosensitive drum 1 was set to 0.6 μm, and that the ten-point average roughness Rz of the surface layer 8*a* of the intermediate transfer belt 8 was set to 1.5 μm.

Example 6

Conditions of Example 6 were the same as those of Example 1 except that the peripheral speed difference between the photosensitive drum 1 and the intermediate transfer belt 8 was set to 3%.

Example 7

Conditions of Example 7 were the same as those of Example 3 except that the peripheral speed difference between the photosensitive drum 1 and the intermediate transfer belt 8 was set to 3%.

Comparative Example 1

The protective layer 1*c* of the photosensitive drum 1 in Example 1 was omitted, and the charge transporting layer 1*b*2 was set as a surface layer of the photosensitive drum 1. Polyarylate resin was used as resin forming the charge transporting layer 1*b*2. The thickness of the charge transporting layer 1*b*2 was set to 23 μm, and the ten-point average roughness Rz of the charge transporting layer 1*b*2 was set to 0.05 μm. Further, the surface layer 8*a* of the intermediate transfer belt 8 in Example 1 was omitted, and the intermediate transfer belt 8 was constructed only by the base layer 8*b*. PEN was used as resin forming the base layer 8*b*. The thickness of the base layer 8*b* was set to 67 μm, and the ten-point average roughness Rz of the base layer 8*b* was set to 0.65 μm. Conditions of Comparative Example 1 were the same as those of Example 1 except for the conditions mentioned above.

Comparative Example 2

The surface layer 8*a* of the intermediate transfer belt 8 in Example 1 was omitted, and the intermediate transfer belt 8 was constructed only by the base layer 8*b*. PEN was used as resin forming the base layer 8*b*. The thickness of the base layer 8*b* was set to 67 μm, and the ten-point average roughness Rz of the base layer 8*b* was set to 0.65 μm. Conditions of Comparative Example 2 were the same as those of Example 1 except for the conditions mentioned above.

Comparative Example 3

The protective layer 1*c* of the photosensitive drum 1 in Example 1 was omitted, and the charge transporting layer 1*b*2 was set as a surface layer of the photosensitive drum 1. Polyarylate resin was used as resin forming the charge transporting layer 1*b*2. The thickness of the charge transporting layer 1*b*2 was set to 23 μm, and the ten-point average roughness Rz was set to 0.05 μm. Conditions of Comparative Example 3 were the same as those of Example 1 except for the conditions mentioned above.

Comparative Example 4

Conditions of Example 4 were the same as those of Example 1 except that the ten-point average roughness Rz of the protective layer 1*c* of the photosensitive drum 1 was set to 0.42 μm, and that the ten-point average roughness Rz of the surface layer 8*a* of the intermediate transfer belt 8 was set to 0.35 μm.

Comparative Example 5

Conditions of Example 5 were the same as those of Example 1 except that the ten-point average roughness Rz of the protective layer 1*c* of the photosensitive drum 1 was set to 0.6 μm, and that the ten-point average roughness Rz of the surface layer 8*a* of the intermediate transfer belt 8 was set to 0.12 μm.

Comparative Example 6

Conditions of Example 6 were the same as those of Example 1 except that the ten-point average roughness Rz of the protective layer 1*c* of the photosensitive drum 1 was set to 0.6 μm, that the ten-point average roughness Rz of the surface layer 8*a* of the intermediate transfer belt 8 was set to 0.12 μm, and that the peripheral speed difference between the photosensitive drum 1 and the intermediate transfer belt 8 was set to 3%.

TABLE 1

| | Photosensitive Drum Surface Layer | | Intermediate Transfer Belt Surface Layer | | Peripheral | Triboelectric Charge | Primary |
|---|---|---|---|---|---|---|---|
| | Material | Rz (μm) | Material | Rz (μm) | Speed Difference | after Transfer (μc/g) | Transfer Performance |
| Example 1 | Acryl | 0.04 | Acryl | 0.38 | 0% | −35.6 | Good |
| Example 2 | Acryl | 0.2 | Acryl | 0.38 | 0% | −38.3 | Good |
| Example 3 | Acryl | 0.6 | Acryl | 0.7 | 0% | −40.1 | Good |
| Example 4 | Acryl | 0.04 | Acryl | 0.6 | 0% | −42.2 | Good |
| Example 5 | Acryl | 0.6 | Acryl | 1.2 | 0% | −43.1 | Good |
| Example 6 | Acryl | 0.04 | Acryl | 0.38 | 3% | −39.2 | Good |
| Example 7 | Acryl | 0.6 | Acryl | 0.7 | 3% | −44.1 | Good |
| Comparative Example 1 | Polyarylate | 0.05 | PEN | 0.65 | 0% | −20.2 | Fail |

TABLE 1-continued

| | Photosensitive Drum Surface Layer | | Intermediate Transfer Belt Surface Layer | | Peripheral | Triboelectric Charge | Primary |
|---|---|---|---|---|---|---|---|
| | Material | Rz (μm) | Material | Rz (μm) | Speed Difference | after Transfer (μc/g) | Transfer Performance |
| Comparative Example 2 | Acryl | 0.04 | PEN | 0.65 | 0% | −19.6 | Fail |
| Comparative Example 3 | Polyarylate | 0.05 | Acryl | 0.38 | 0% | −25.2 | Fail |
| Comparative Example 4 | Acryl | 0.42 | Acryl | 0.35 | 0% | −32.3 | Fail |
| Comparative Example 5 | Acryl | 0.6 | Acryl | 0.12 | 0% | −33.1 | Fail |
| Comparative Example 6 | Acryl | 0.6 | Acryl | 0.12 | 3% | −34.1 | Fail |

From Table 1, it can be understood that, through use of the photosensitive drum 1 and the intermediate transfer belt 8 each having a surface layer containing acrylic resin, the triboelectric charge imparting effect with respect to toner at the primary transfer portion N1 is improved, and thus the primary transfer performance is improved (Example 1, Example 4, and Comparative Example 1 to Comparative Example 3). Further, in this case, it can also be understood that, through setting of the ten-point average roughness Rz of the intermediate transfer belt 8 within the range of 0.35 μm≤Rz≤1.5 μm, degradation of the triboelectric charge imparting effect with respect to toner at the primary transfer portion N1 can be suppressed, and thus degradation of the primary transfer performance can be suppressed (Example 1 to Example 7 and Comparative Example 4 to Comparative Example 6).

Another Embodiment

The present invention has been described by way of a specific embodiment, but the present invention is not limited to the above-mentioned embodiment.

In the above-mentioned embodiment, the image bearing member is a photosensitive member having a drum shape. However, the image bearing member is not limited thereto, and may be, for example, a photosensitive member having an endless belt shape. Further, in an image forming apparatus using an electrostatic recording method, the image bearing member may be an electrostatic recording dielectric.

Further, in the above-mentioned embodiment, the intermediate transfer member is an endless belt looped around the plurality of tensioning rollers. However, the intermediate transfer member is not limited thereto. For example, the intermediate transfer member may be formed of a drum shape film stretched on a frame member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-012547, filed Jan. 26, 2017 which is hereby incorporated by reference herein in its entirety.

What is claimed is:

1. An image forming apparatus comprising:

a photosensitive member configured to bear a toner image, the photosensitive member having a surface layer containing acrylic resin; and an intermediate transfer member configured to secondarily transfer the toner image having been primarily transferred from the photosensitive member onto a transfer material, the intermediate transfer member having a surface layer containing acrylic resin and having a ten-point average roughness Rz set within a range of 0.35 μm≤Rz≤1.5 μm.

2. An image forming apparatus according to claim 1, wherein the ten-point average roughness Rz of the surface layer of the intermediate transfer member is larger than a ten-point average roughness Rz of the surface layer of the photosensitive member.

3. An image forming apparatus according to claim 2, wherein the ten-point average roughness Rz of the surface layer of the photosensitive member is set within a range of 0.03 μm≤Rz≤1.0 μm.

4. An image forming apparatus according to claim 3, wherein the photosensitive member is cylindrical.

5. An image forming apparatus according to claim 4, wherein the intermediate transfer member comprises an endless belt.

6. An image forming apparatus according to claim 5, wherein the endless belt includes a base layer and the surface layer of the intermediate transfer member which covers the base layer.

7. An image forming apparatus according to claim 6, wherein the surface layer of the intermediate transfer member contains insulating particles.

8. An image forming apparatus according to claim 7, wherein the insulating particles comprise polytetrafluoroethylene resin powder.

* * * * *